United States Patent [19]

Halstead

[11] 4,319,706

[45] Mar. 16, 1982

[54] PERCUSSION TOOL

[76] Inventor: Donald B. Halstead, 1516 Salrlmar Ave., San Dimas, Calif. 91773

[21] Appl. No.: 109,237

[22] Filed: Jan. 3, 1980

Related U.S. Application Data

[63] Continuation of Ser. No. 961,619, Nov. 17, 1978, abandoned, which is a continuation of Ser. No. 747,786, Dec. 6, 1976, which is a continuation of Ser. No. 565,542, Apr. 7, 1975.

[51] Int. Cl.[3] ..... B25C 1/04

[52] U.S. Cl. ..... 227/126; 227/120; 227/130

[58] Field of Search ..... 227/120, 125, 126, 130

[56] References Cited

U.S. PATENT DOCUMENTS

| | | | |
|---|---|---|---|
| 3,086,207 | 4/1963 | Lingle et al. | 227/130 |
| 3,253,760 | 5/1966 | Doyle et al. | 227/120 |
| 3,266,697 | 8/1966 | Fiedler | 227/120 |
| 3,568,909 | 3/1971 | Perkins | 227/130 |
| 3,776,445 | 12/1973 | Pomeroy | 227/130 |
| 3,797,723 | 3/1974 | Perkins et al. | 227/126 X |
| 3,820,705 | 6/1974 | Beals | 227/120 |
| 3,871,566 | 3/1975 | Elliesen et al. | 227/130 |
| 3,945,550 | 3/1976 | Monacelli | 227/126 |

FOREIGN PATENT DOCUMENTS

| | | | |
|---|---|---|---|
| 901535 | 4/1954 | Fed. Rep. of Germany | 227/120 |

*Primary Examiner*—Paul A. Bell

*Attorney, Agent, or Firm*—Fitch, Even, Tabin, Flannery & Welsh

[57] ABSTRACT

A percussion tool, disclosed as a nail driver, having a plunger-like hammer or driver which is driven through working and return strokes by a power piston movable in a cylinder which is pressurized with a working fluid and vented by selective actuation of a unique and simplified valving arrangement to effect the working and return strokes. The disclosed nail driver has a nail magazine which is attached to the tool in a novel and rugged manner which resists bending and other damage of the magazine by the periodic impact forces generated in the course of nail driving operation of the tool.

1 Claim, 16 Drawing Figures

PERCUSSION TOOL

This is a continuation of application Ser. No. 961,619, filed Nov. 17, 1978, now abandoned, which is a continuation of Ser. No. 747,786 filed Dec. 6, 1976 which is a continuation of Ser. No. 565,542, filed Apr. 7, 1975.

BACKGROUND OF THE INVENTION

1. Field of the Invention

This invention relates generally to fluid pressure operated tools and more particularly to an improved fluid pressure operated percussion tool and nail driver.

2. Prior Art

As will appear from the later description, certain features of the invention may be utilized in a wide variety of fluid pressure operated percussion tools. These features, however, are particularly useful in, and another feature of the invention is limited in usefulness to, nail drivers. For this reason, the invention will be described in the context of a nail driver.

The prior art is replete with a vast assortment of fluid pressure operated nail driving tools. While these nail driving tools may differ substantially in their structural details, most if not all are characterized by a body containing a cylinder and a power piston movable in the cylinder and having a plunger-like hammer or driver extending axially through the front end of the cylinder into an external guideway on the body. Trigger actuated valve means are provided for admitting a working fluid, such as air, into and venting the fluid from the opposite or rear cylinder end in such a way as to effect driving of the power piston through a forward working stroke and a following rearward return stroke in its cylinder. This motion of the piston, in turn, drives the nail driver through a nail driving stroke and a following return stroke in its guideway.

Mounted removably on the tool body adjacent the nail driver guideway is a nail magazine including a spring loaded follower or other means for feeding nails in succession into the guideway in front of the nail driver. During each driving stroke of the nail driver, the latter strikes the head of the nail currently positioned in the guideway and drives the nail forwardly through the open end of the guideway into a workpiece. The driver is then returned rearwardly to its initial retracted position. During this return stroke of the driver, when its front tip finally clears the nail infeed opening, another nail is fed into the guideway in readiness to be driven into a workpiece during the next driving stroke of the driver.

A variety of valving arrangements have been devised for pressurizing and venting the tool power cylinder to effect the tool operating or nail driving cycle described above. This invention is concerned with valving arrangements of the class which utilize a trigger operated pilot valve means for actuating a main fluid pressure operated cylinder valve that controls actual pressurizing and venting of the power cylinder. Nail driving tools having valving arrangements of this class are described in U.S. Pat. Nos. 3,194,324; 3,253,760; and 3,820,705. Other nail driving tools are described in U.S. Pat. Nos. 2,872,901; 3,081,740; 3,081,741; 3,081,742; 3,084,672; 3,086,207; 3,094,900; 3,106,136; 3,229,589; 3,622,062 and 3,596,821. While these patented valving arrangements and nail driving tools are perhaps capable of nail driving operation, they are relatively complex in construction, costly to fabricate, embody a relatively large number of parts and hence are prone to mal-function and costly and time consuming to repair, and are otherwise not totally satisfactory.

Another problem area of the existing nail driving tools resides in their nail magazines. In the past, these magazines have been attached to the tool body in a manner such that the repeated impact forces generated during tool operation often caused bending, cracking and other damage of the magazines. Such damage, of course, incapacitates the entire tool and is often difficult and time consuming to repair.

SUMMARY OF THE INVENTION

Accordng to one of its important aspects, this invention provides a percussion tool having a power cylinder containing a power piston with a plunger-like hammer which extends through the front end of the cylinder to the exterior of the tool body for delivering a blow to a workpiece in response to movement of the piston through a forward power or working stroke and a rearward return stroke in the cylinder. A unique pilot operated valving arrangement is provided for pressurizing and venting the rear cylinder end to effect driving of the piston through these strokes. This valving arrangement is characterized by its relatively simple, low cost construction, reliability of operation, and other highly advantageous and practical features.

The valving arrangement comprises a cylinder valve member mounted within the tool body for movement to and from a closed position of seating engagement of one side of the member with a valve seat about a rear end opening in the power cylinder through which the rear cylinder end opens to a working fluid reservoir chamber in the tool body when the valve member is in open position spaced from the valve seat. The reservoir chamber has an inlet for connection to a source of pressurized working fluid, such as air. Behind the valve member is a valve chamber which is adapted to be pressurized with working fluid from the reservoir chamber to close the valve member against a valve opening force which, in the described inventive embodiment, is provided by the working fluid pressure in the reservoir chamber.

The valve chamber is selectively vented and pressurized through a novel pilot valve means comprising a single pilot valve member. Movement of this pilot valve member to one position vents the valve chamber to effect opening of the cylinder valve member and driving of the power piston and its hammer through a forward power or working stroke by the pressure of working fluid entering the power cylinder from the reservoir chamber through the rear cylinder opening. Movement of the pilot valve member to another position pressurizes the valve chamber with working fluid from the reservoir chamber to close the cylinder valve member. The power cylinder and its hammer are then driven through a rearward return stroke by a return force which, in the described embodiment, is furnished by the pressure of a gas which is compressed within a compression chamber opening to the front end of the power cylinder during the forward working stroke of the piston. Closure of the cylinder valve member also vents the rear power cylinder end to permit return of the power piston by the return force.

The particular percussion tool described is a fastener driving tool, specifically a nail driving tool for driving nails which are packaged in strip form, as described in U.S. Pat. No. 3,432,985, with the heads of the adjacent nails overlapping one another and the nail shanks joined by a frangible plastic strip. Another aspect of the invention is concerned with a magazine arrangement for the nail driving tool for feeding the packaged nails in succession into a guideway which slidably receives the outer end of the power piston hammer. Each time the hammer is retracted rearwardly in the guideway by a return stroke of the power piston, a nail is fed into the guideway in front of the hammer. During the following forward working stroke of the piston, the hammer is driven forwardly through a driving stroke to drive the nail into a workpiece. The hammer is retracted to a rearward position spaced some distance from the nail head such that the hammer develops substantial kinetic energy before impacting the nail. An important feature of the invention resides in the attachment of the nail magazine to the tool body. According to this feature, the hammer guideway is contained within a rugged nosepiece or end fitting on the tool body. This end fitting has lateral projections over which the nail magazine fits and to which the magazine is removably fastened. The end fitting projections are formed with shoulder-like anvils which support the heads of the nails in the nail strip package adjacent the leading nail being driven in such a way that the plastic bending strip of the package is sheared off cleanly during driving of the leading nail. The construction and arrangement of the tool nosepiece or end fitting, nail magazine, and attachment of the magazine to the fitting are such as to avoid bending, breaking and other damage of the magazine by the repeated impacts occurring during tool operation.

DESCRIPTION OF THE PREFERRED EMBODIMENT

Figure 2:
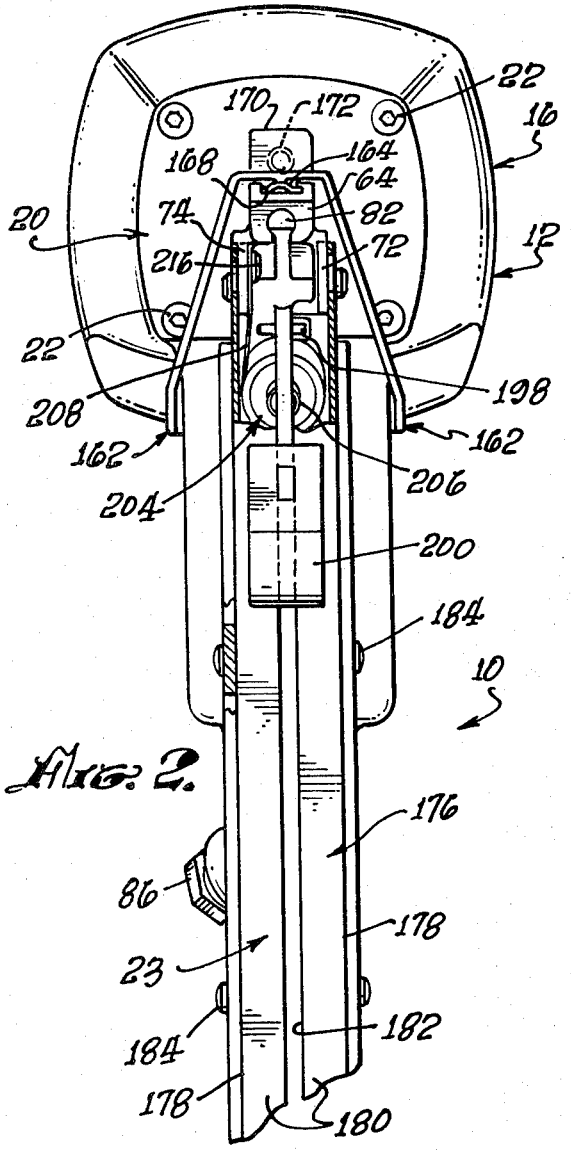
FIG. 2 is an enlarged front view of the tool.
Figure 3:
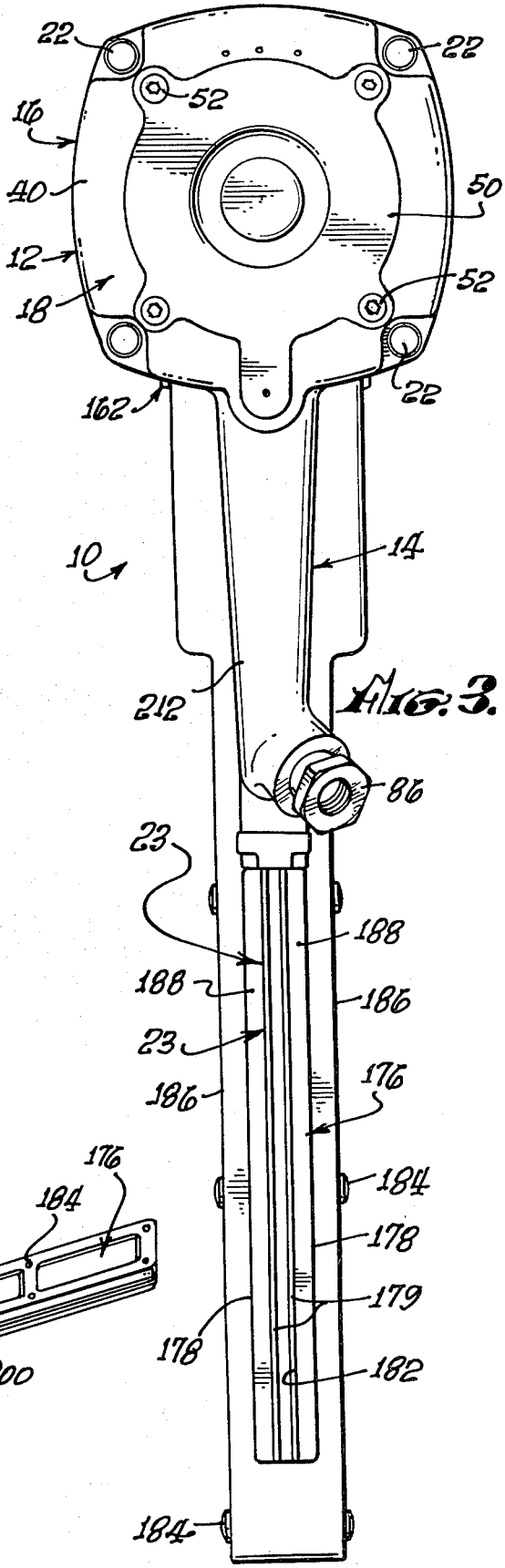
FIG. 3 is an enlarged rear view of the tool.
Figure 1:
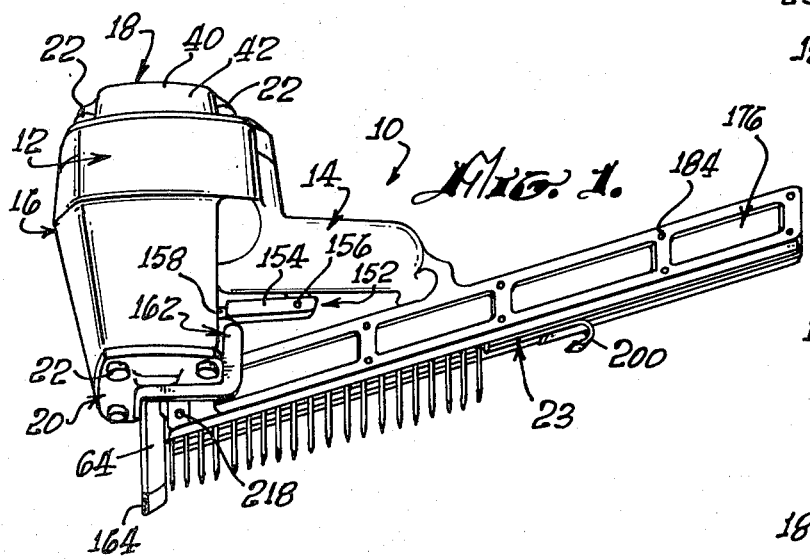
FIG. 1 is a perspective view of a nail driving tool according to the invention.

The nail driving tool 10 illustrated in the drawings has a hollow body 12 with a laterally projecting pistol grip handle 14. Body 12 comprises a generally tubular center section 16 formed integrally with the handle 14, a rear end closure 18, and a front end nosepiece or end fitting 20. These parts are releasably joined by bolts 22. Removably attached to the front end of the body is a nail magazine 23 for feeding nails in succession to driving position in the end fitting 20, as explained later.

Figures 4, 5, 6, 7, 8, 16:
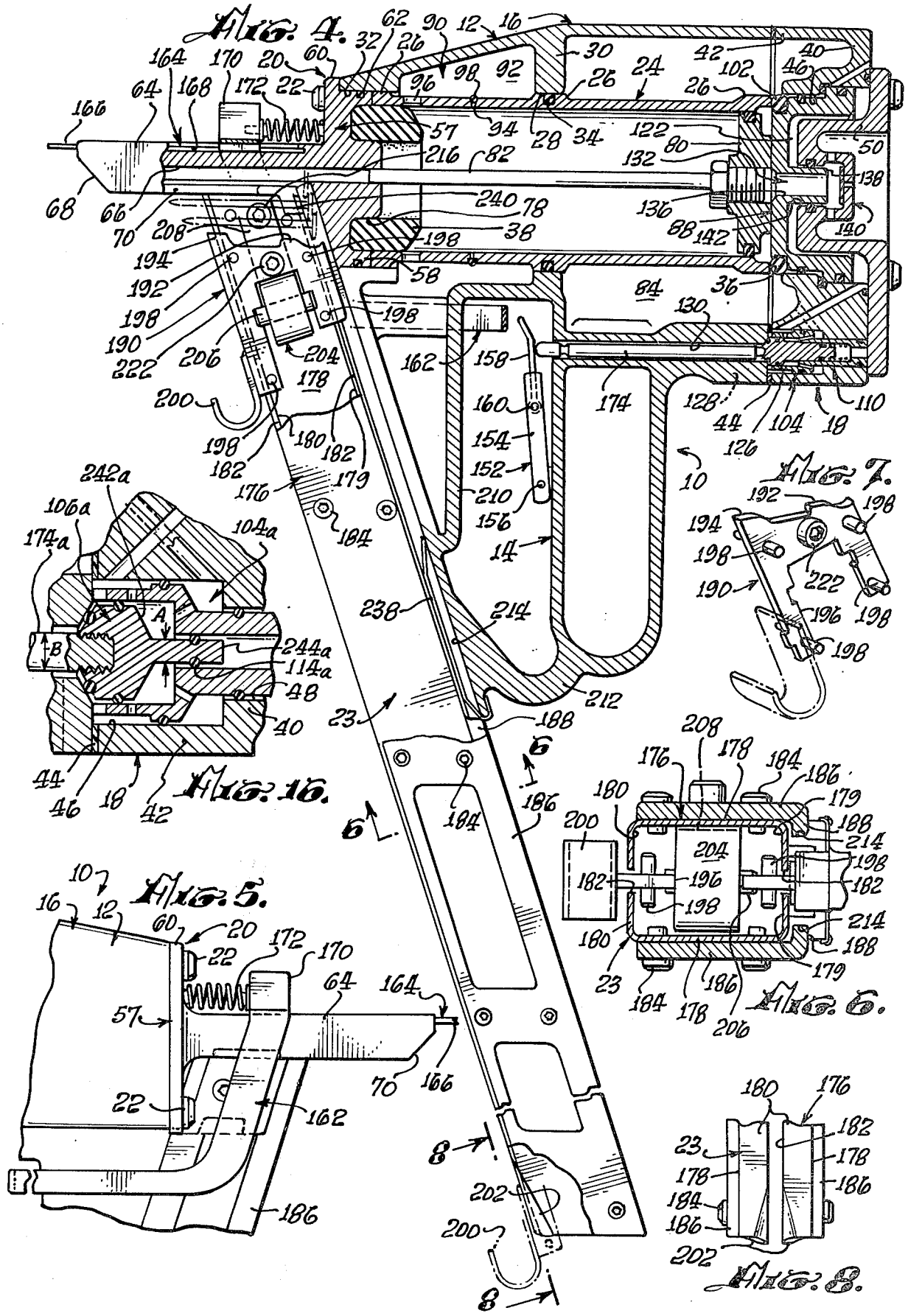
FIG. 4 is an enlarged section through the tool showing its parts in their normal positions.
FIG. 5 is an enlarged fragmentary view of the front end of the tool, showing the side opposite that shown in FIGS. 1 and 4.
FIG. 6 is an enlarged section taken on line 6—6 in FIG. 4.
FIG. 7 is an enlarged perspective view of a follower embodied in the nail magazine of the tool.
FIG. 8 is a view taken on line 8—8 in FIG. 4.
FIG. 16 illustrates a modified pilot valve for the tool.

Within the body section 16 is a power cylinder 24 having external shoulders or ribs 26 which fit snugly within a central opening 28 through an internal partition 30 and a front end opening 32 of the body section. The cylinder is sealed to the partition 30 by an O-ring 34. The rear or right hand end of the cylinder in FIG. 4 is open to form a rear end opening in the cylinder surrounded by the rear edge 36 of the cylinder. The front end of the cylinder is closed by the front end fitting 20 and a resilient bumper 38, as explained in more detail presently.

The rear end closure 18 of the tool body 12 comprises an end cap 40 with a forward projecting edge wall 42 which conforms to and seats against a gasket 44 on the rear end of the center body section 16. Extending through the end cap 40 on the axis of the cylinder 24 is a bore 46 which is counter bored at 48 to form a stepped cylinder. The rear end of the cylinder 46 is closed by a cover member 50 which is attached by bolts 52 to the rear side of the end cap 40 and has a cylindrical cup formation 54 projecting axially into the cylinder 46 in radially spaced relation to the cylinder wall. Cover member 50 is sealed to the end cap by an O-ring 56. The end cap 40 is secured by bolts 22 to the rear end of the center body section 16.

Figure 12:
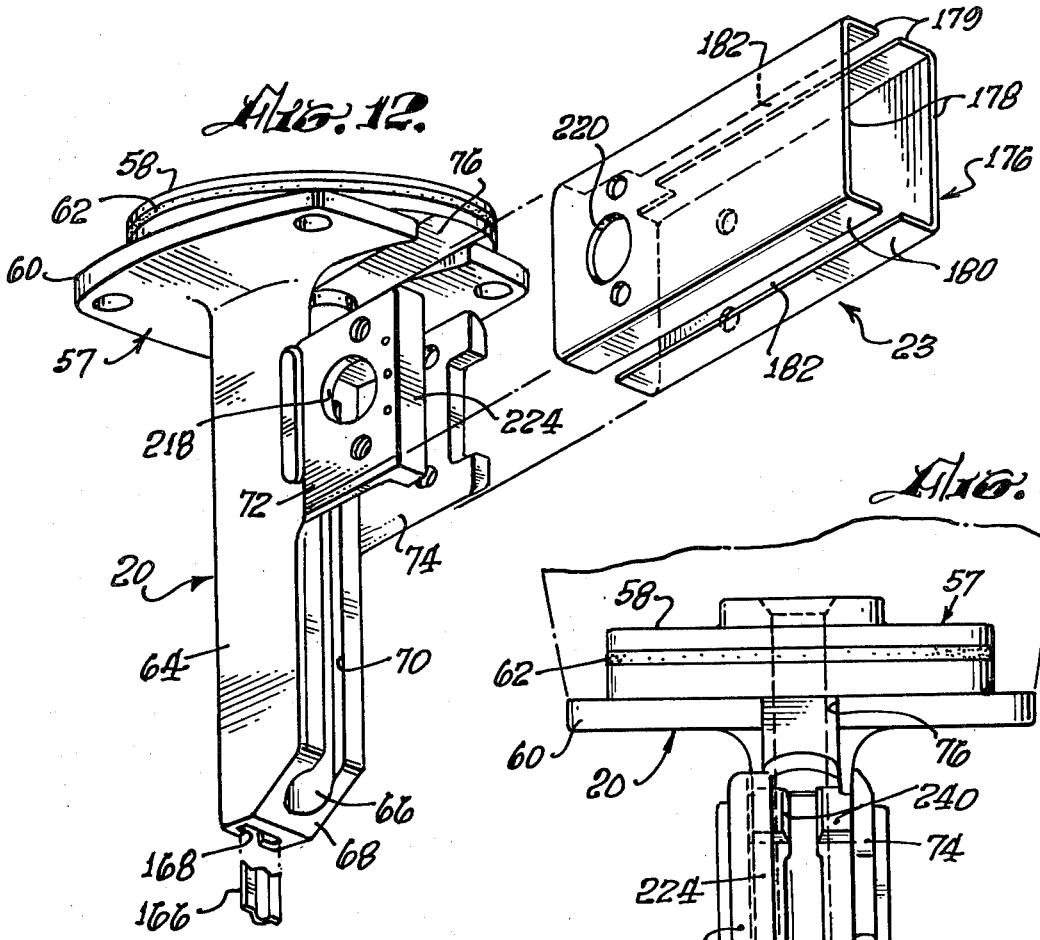
FIG. 12 is an enlarged exploded fragmentary perspective view of the nosepiece or end fitting and nail magazine of the tool.
Figure 13:
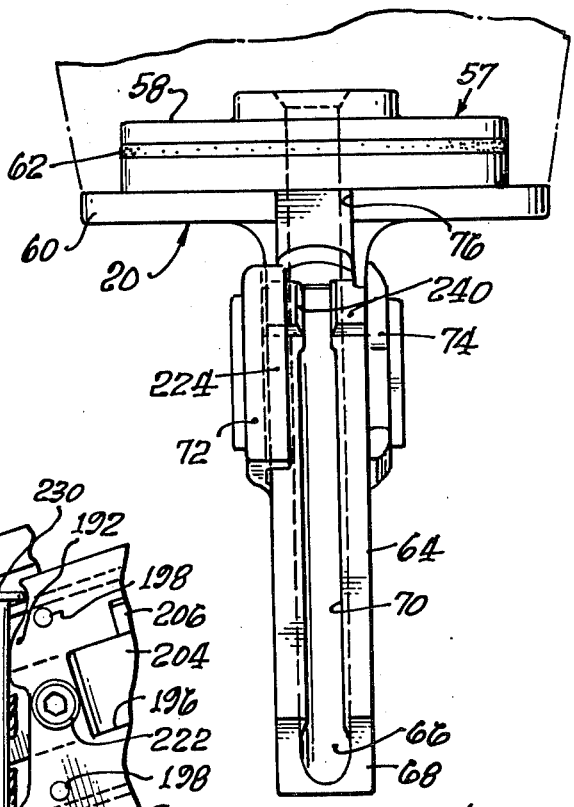
FIG. 13 is a side view of the end fitting.

The front end fitting 20 of the tool body 12 has a coupling base 57 including a cylindrical boss 58 which fits slidably in the front end opening 32 of the center body section 16 and a flange 60 which seats against the front end of the body section about the opening 32. The end fitting is sealed to the body section by an O-ring 62. The fitting flange 60 is attached to the center body section by the bolts 22. Integrally joined to and projecting forwardly from the fitting base 57 along the axis of the power cylinder 24 is a generally tubular extension 64 of rectangular cross-section containing a circular bore 66 aligned with the cylinder axis and opening rearwardly through the base into the front end of the power cylinder and forwardly through the front end of the extension. The front end of the extension is beveled at 68. Bore 66 opens laterally through one side of the extension 64, along the full length of the extension, through a longitudinal slot 70 in the extension. Integrally joined to the extension 61, adjacent the end fitting base 57, and projecting laterally and rearwardly of the extension parallel to a plane containing the axis of the bore 66 and the longitudinal centerline of the slot 70 are a pair of generally rectangular plate-like flanges 72, 74 which are apertured as shown best in FIG. 12. The end fitting base flange 60 has a slot-like recess 76 aligned with the flanges. Additional structure of the end fitting 20 will be described presently.

The front end of the power cylinder 24 seats against the rear face of the end fitting boss 58. The resilient bumper 28 referred to earlier is generally toroidal in shape and fits snugly within an annular recess 78 in the boss. The bumper projects rearwardly into the front end of the power cylinder 24 and is externally sized to fit snugly in the cylinder so as to seal the front cylinder end.

Movable in the power cylinder 24 is a power piston 80. A rod 82, which constitutes a plunger-like hammer or nail driver, is rigidly fixed at its rear to the piston and extends forwardly through the cylinder into the end fitting bore 66. Bore 66 slidably receives and serves as a guideway for the nail driver 82. Piston 80 and nail driver 82 normally occupy their rear retracted position of FIG. 4 and are movable forwardly through a working or driving stroke to their forward extended position of FIG. 9 and rearwardly through a return stroke to their normal retracted position of FIG. 4. This back and forth motion of the piston and driver through a driving stroke and a following return stroke constitutes one nail driving cycle of the tool. It is significant to note here that during each driving stroke the front tip end of the driver 82 moves from an initial position at the extreme rear end of its guideway 66 to a final position beyond the front end of the guideway. As will be explained later in connection with the tool operation, forward travel of the driver is partially arrested by impact of the piston 80 against the bumper 28 which compresses to absorb the kinetic energy of the piston and driver.

The interior space of the tool body 12 rearwardly of its interior partition 30, including the annular space about the rear end of the power cylinder 24 and the space within the tool handle 14, provides a reservoir chamber 84. Mounted on the tool body is an inlet 86 to the reservoir chamber for connection to a source of pressurized working fluid, such as air. It will be understood, therefore, that when the inlet is connected to a working fluid source, the reservoir chamber will contain the working fluid under pressure. The rear open end of the power cylinder 24 is located within the reservoir chamber 84 but is normally closed by a cylinder valve member 88 to be described presently so as to isolate the rear cylinder end from the chamber. As explained in the later description, when the cylinder valve member is opened, the rear end of the power cylinder opens to the reservoir chamber whereby pressurized working fluid may enter the cylinder from the chamber to drive the power piston 80 and nail driver 82 through a forward working or nail driving stroke. The valve member is then reclosed and the rear end of the power cylinder is vented to permit movement of the piston and driver through a rearward return stroke.

The piston 80 and driver 82 are driven through their return stroke by return means 90. A variety of return means may be utilized for this purpose. The particular return means shown comprises a gas, such as air, which frees the power cylinder 24 forwardly of the piston 80 and a compression chamber 92 about the front end of the cylinder formed by the interior space of the tool body 12 forwardly of its partition 30. In the wall of the cylinder are ports 94, 96 opening to the compression chamber 92. Surrounding the cylinder over the ports 94 is an O-ring 98. During each forward working or driving stroke of the piston 80, the gas within the front end of the cylinder 24 is displaced from the cylinder into the compression chamber 92 through the ports 94, 96 (O-ring 98 unseats to permit outward gas flow through the ports 94) and is compressed within the cylinder and chamber. When the rear end of the cylinder is vented as mentioned earlier and explained in detail later, the pressure of the compressed gas drives recenters the cylinder from the compression chamber, to thus drive the piston rearwardly, through the cylinder ports 96, ports 94 being then closed by O-ring 98 which thus operates as a check valve. This valving function is necessitated by the fact that the piston, when at the forward end of its stroke, is located forwardly of the ports 94.

As mentioned above, the rear end of the power cylinder 24 is normally closed by the cylinder valve member 88. This valve member comprises a generally cup-shaped piston which slides in the cylinder 46 of the rear body end closure 18 and is sealed to the cylinder wall by an O-ring 100. The forward end of the valve piston projects forwardly through the open front end of the cylinder 46 and carries an O-ring 102 for engagement with the rear end valve seat 36 of the cylinder 24. Thus, forward movement of the valve piston 88 to its closed position of FIG. 4 engages its O-ring 102 with the power cylinder valve seat 36 to isolate the power cylinder from the reservoir chamber 84. Rearward movement of the valve piston 88 to its open position of FIG. 9 separates its O-ring 102 from the power cylinder valve seat 36 to permit passage of pressurized working fluid from the reservoir chamber to the rear end of the power cylinder to drive the power piston 80 and nail driver 82 forwardly through a working or driving stroke. It is significant to note here that opening reservoir chamber to the rear end of the power cylinder to drive the power piston 80 and nail driver 82 forwardly through a working or driving stroke.

Piston valve member 88 is moved between its open and closed positions by working fluid pressure under control of a trigger actuated pilot valve means 104 which is uniquely constructed and arranged in accordance with one important aspect of the invention. Pilot valve means 104 comprises a pilot valve member 106 slidable in a valve bore 108 within a valve body 110 which fits within a bore 112 in the tool body end cap 42. Pilot valve member 106 is sealed to the wall of its bore 108 by O-rings 114. The valve member is urged to its normal position of FIG. 4 by a spring 116 and is moved to its retracted position of FIG. 9 by trigger action, as explained presently.

Pilot valve bore 108 communicates to the reservoir chamber 84 through a passage 118 in the end cap 42 and passages 120 in the pilot valve body 110. Between the end cap cover member 50 and the cylinder piston valve 88 is a valve pressure chamber 122 which communicates to the pilot valve bore 108 through a passage 124 in the end cap and lateral ports 126 in the pilot valve body. Finally, the forward end of the pilot valve bore communicates to a vent passage 128 in the center tool body section 16 through a longitudinal bore 130 in the body section coaxially aligned with the pilot valve bore.

Figures 9, 10, 11:
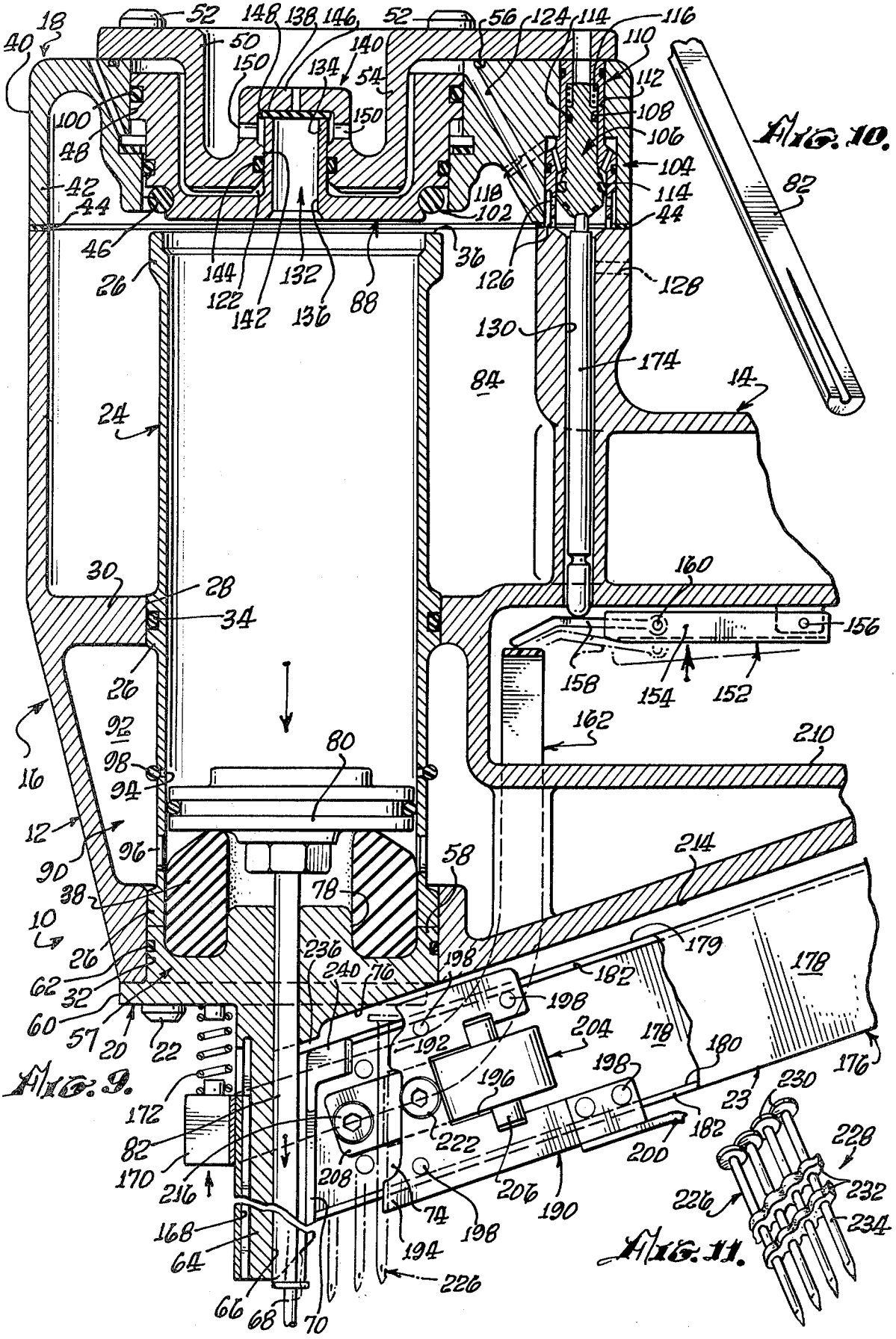
FIG. 9 is a view similar to FIG. 4, on enlarged scale and showing the tool in one condition of operation.
FIG. 10 is a perspective view of the tool nail drive or hammer.
FIG. 11 is a fragmentary perspective view of a nail package for use in the tool.

Referring now particularly to FIGS. 4 and 9, it will be seen that when the pilot valve member 106 occupies its normal position of FIG. 4 under the thrust of the valve spring 116, the valve member communicates passages 118, 124 to permit passage of working fluid from the reservoir chamber 84 to the cylinder valve chamber 122 and closes the bore 130 to block fluid passage through the vent 128. The valve chamber is thereby pressurized with working fluid. It will be observed that this fluid pressure acts on the rear effective surface area of the piston valve 88 in opposition to the working fluid pressure within the reservoir chamber 84 which acts on the front effective surface area of the valve. The rear effective area of the valve is greater than its front effective area so that pressurizing of the valve chamber 122 drives the valve forwardly to closed position of engagement with the power cylinder valve seat 36. Retraction of the pilot valve member 106 to its rear position of FIG. 9 blocks communication between the reservoir and valve chambers 84, 122 through passages 118, 124 and opens the tool body bore 130 to communicate passage 124 to the vent 128, thereby venting the valve chamber. The working fluid pressure in the reservoir chamber then drives the cylinder piston valve 88 to its open position of FIG. 9.

As noted earlier, opening of the cylinder piston valve 88 admits working fluid to the rear end of the power cylinder 24 from the reservoir chamber 84 to drive the power piston 80 and nail driver 84 forwardly through a working or nail driving stroke. The pressure of the compressed gas in the front end of the cylinder and in the compressive chamber 92 at the end of the driving stroke returns the piston and drives rearwardly through a return stroke when the cylinder valve is closed and the rear end of the cylinder is vented.

Venting of the rear end of the power cylinder 24 in response to closing of the cylinder valve 88 is accomplished by vent valve means 132. This vent valve means comprises a coaxial valve sleeve 134 formed integrally with and extending rearwardly of the cylinder valve. Valve sleeve 134 contains a vent passage 136 surrounded at its rear end by a valve seating edge 138 formed by the rear end edge of the sleeve. The tool body end cap cover member 50 has a generally cup-shaped formation 140 providing a bore 142 which slidably receives the valve sleeve 134 and containing a seal ring 144 engaging the sleeve. Extending across the rear end of the bore 142 is a wall 146, to the front side of which is fixed a resilient valve seat member 148 against which the seating edge 138 of the valve sleeve 134 seats to close the vent passage 136 when the power cylinder valve member 88 occupies its open position of FIG. 9. Closing of the cylinder valve member separates the sleeve seating edge 138 from the valve seat 148 to communicate the vent passage 136 with vent passages or ports 150 in the cover member 50. It will now be understood, therefore, that closing of the cylinder valve 88 to isolate the rear end of the power cylinder 24 from the reservoir chamber 84 simultaneously vents the rear power cylinder end to permit return of the power piston 80 and driver 82 by the compressed gas in the front end of the cylinder and the compression chamber 92.

As noted earlier, the pilot valve member 106 is retracted from its normal position of FIG. 4 to its position of FIG. 9 by trigger action. To this end, the tool has a trigger 152 on the tool handle 14. This trigger comprises a lever 154 pivoted at one end on the handle by a pin 156 and a lever 158 pivoted at one end on the opposite end of lever 154 by a pin 160. Pivoting of lever 158 relative to lever 154 is limited to a small angle by stop means (not shown).

The opposite or free end of trigger lever 158 engages the rear end of a rear yoke 162 of a safety touch probe 164. This yoke has arms which extend forwardly and curve toward and straddle the tool body end fitting extension 64. The forward ends of the yoke arms are rigidly joined to a probe slide 166 which slides in a longitudinal guideway 168 in the side of the extension 64 opposite its slot 70. Fixed to the rear end of slide 166 is a block 170 between which and the end fitting coupling hose 57 is positioned a compression spring 172. Spring 172 urges the touch probe 164 forwardly to its forward extended position of FIGS. 4 and 12 wherein the front end of the probe slide projects forwardly of the end fitting extension, as shown. The probe is retractably rearwardly against spring pressure to its retracted position of FIG. 9.

Slidable within the tool body bore 130 is a trigger rod 174. The rear end of this rod is fixed to or engages the pilot valve member 106. The front end of the rod engages the trigger lever 158 between its ends. The pivot valve spring urges the rod forwardly and thereby the trigger 152 forwardly away from the handle 14. Assuming the touch probe 162 is extended as in FIG. 4, rearward depression of the trigger toward the handle by finger pressure on the trigger lever 154 has no effect, since the pilot valve spring force on the trigger rod 174 retains the latter forward and causes the trigger lever 158 to simply swing forwardly relative to lever 154. When the probe is in its retracted position, the free end of the trigger lever 158 rests on the rear yoke 162 of the probe 164, and the pressure of the trigger rod 174 against the trigger lever 158 causes the trigger 152 to assume its broken line position of FIG. 9. Now when the trigger lever 154 is depressed, the lever 158 is rotated rearwardly about its free end as a fulcrum and against the trigger rod 174 to retract the rod and thereby the pilot valve member 106 rearwardly against the thrust of the pilot valve spring 116.

From the description to this point, it will be understood that in the normal inoperative condition of the nail driving tool, the heretofore described tool parts occupy their normal positions shown in FIG. 4. Retraction of the touch probe 162 followed by depression of the trigger 152 retracts the pilot valve member 106 to vent the cylinder valve chamber 122 and thereby effect opening of the cylinder valve 88 by the working fluid pressure in the reservoir chamber 84. The power piston 80 and nail driver 82 are then driven through a forward working or driving stroke by the pressure of working fluid entering the rear end of the power cylinder 24 from the reservoir chamber, thereby compressing the gas in the front end of the cylinder and in the compression chamber 92. When the trigger 152 is released, the pilot valve member 106 returns to its normal forward position by the force of its spring 116 to repressurize the cylinder valve chamber 122 from the reservoir chamber 92 and thereby reclose the cylinder valve 88. The vent valve 132 opens upon closure of the cylinder valve to vent the rear end of the power cylinder through the vent passages 136, 150 and thereby permit return of the power piston 80 and driver 82 by the compressed gas in the compression chamber. Thus, each time the trigger 152 is depressed and released, the piston and driver are driven through a driving stroke and a following return stroke.

As noted earlier, the nail driving tool has a nail magazine 23 for feeding nails in succession into driving position in the tool end fitting 20. This magazine comprises an elongate sheet metal housing 176 of rectangular tubular cross-section with side walls 178 having inturned flanges 179, 180 along their upper and lower edges defining intervening slots 182 extending lengthwise of the housing. Attached by bolts 184 to the housing side walls are side plates 186 with upper inturned flanges 188 which extend inwardly over and in spaced relation to the rear housing flanges 179.

Movable lengthwise through the magazine housing 176 is a pusher or follower 190. As shown best in FIGS. 7 and 14, this follower comprises a plate with a lead edge having spaced nail engaging portions 192, 194 which project forwardly of the remainder of the edge. At the rear of the follower plate is a cutout 196 which opens through the rear edge of the plate. Pins 198 are fixed in and project beyond opposite sides of the plate. Follower plate 190 is positioned in the magazine housing 176 in the plane of its slots 182 with the upper and lower plate edges projecting through the slots. The plate pins 198 are located within the housing for engagement with the housing flanges 179, 180 to retain and guide the plate in the housing. Fixed to the front or left hand edge of the follower plate in FIG. 4 is a curved finger piece 200 by which the slide plate may be retracted to the outer end of the magazine as explained later. The outer ends of the front magazine housing flanges 180 are turned up as shown best in FIGS. 4, 6 and 8 to provide catch tabs 202 over which the front rear plate pin may be engaged in the manner shown in broken lines in FIG. 4 to retain the plate retracted, also as explained later.

Positioned within the rear cutout 196 of the follower plate 190 is a negator spring 204 having a shaft 206 fitting in recesses in the edges of the cutout, as shown in FIG. 4. The spring is retained laterally in the cutout by the sidewalls 178 of the magazine housing 176. The free end of the negator spring hand 208 extends along one side of the follower plate toward the inner end of the magazine 23.

Nail magazine 23 is removably mounted on the tool body 12. To this end, the front end of the body has a lateral projection 210 which contains a portion of the compression chamber 92 and is joined at its outer end to the handle 14 by a web 212 along opposite sides of this body extension are grooves 214 for slidably receiving the rear magazine side plate flanges 188 in the manner shown in FIG. 6. The magazine is assembled on the tool by inserting the inner ends of the side plate flanges 186 into the outer ends of the body grooves 214 and sliding the magazine inwardly toward the tool front end fitting 20 to a final position wherein the inner end of the magazine housing telescopes over the fitting flanges 72, 74. In this regard, it should be noted that the flanges are spaced and sized to fit closely in the magazine housing. The rear edge of the magazine fits within the end fitting base recess 76. The magazine is removably attached to the end fitting flanges by bolts (not shown).

The free end of the negator spring band 208 is attached to the inner side of the end fitting flange 74 by a bolt 216 which is accessible through access openings 218 in the end fitting flange 72 and 220 in the magazine housing 176. Negator spring 204, which is carried by the follower slide 190 as described earlier, urges the slide inwardly through the nail magazine 23 toward the guideway 66 in the tool body end fitting 20 to its inner limiting position of FIG. 4 where the slide is arrested by contact of a stop 222 on the slide with a stop shoulder 224 on the end fitting flange 72. As noted earlier, the slide is retracted outwardly through the nail magazine by pulling on its finger piece 200 and may be releasably retained in its outer retracted position as shown in broken lines in FIG. 4.

Figure 14:
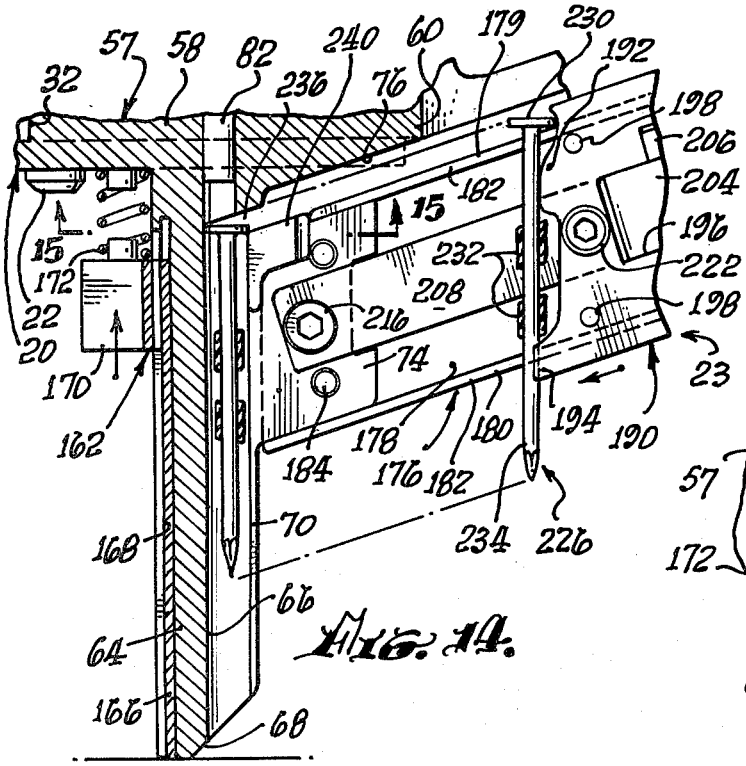
FIG. 14 is an enlarged section through the end fitting and magazine when assembled.
Figure 15:
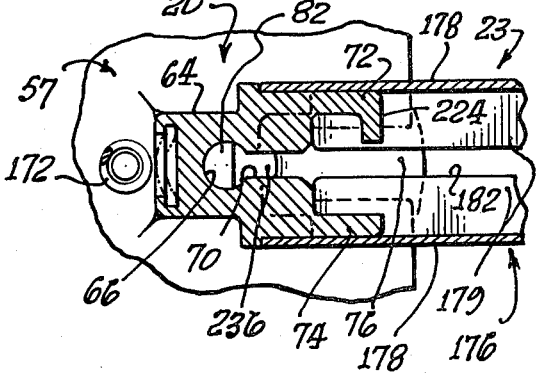
FIG. 15 is a section taken on line 15—15 in FIG. 14.

The nail driving tool is adapted to drive nails 226 which are packaged in a strip 228 as shown in FIG. 11. This nail strip package comprises a group of nails 226 arranged side by side with their heads 230 overlapping one another in the manner shown and bands 232 of frangible plastic joining the nail shanks 234. As mentioned earlier, this nail package or strip is described in U.S. Pat. No. 3,432,985. A nail strip 228 is loaded into the nail magazine 23 in front of the follower slide 190 with the latter locked in its outer retracted position of FIG. 4. As shown in FIG. 14, the nail strip is placed in the magazine in such a way that the nail heads 230 ride on the upper surfaces of the rear magazine housing flanges 179 and the nail shanks 234 extend through the magazine slots 182 and beyond the front side of the magazine. The leading edge parts 192, 194 of the follower slide 190 are arranged to engage the shank of the outermost or last nail in the strip at opposite sides of the plastic hands 232. Accordingly, when the slide is released from its locked position shown in broken lines in FIG. 4, the nail strip is urged inwardly through the magazine by the negator spring force on the slide.

This spring force on the follower slide 190 urges the nail strip 228 inwardly to a position (FIG. 14) where the leading nail 226 in the strip is located in driving position in the driver guideway 66 of the tool body end fitting 20, forwardly of the nail driver 82 when the latter is retracted to its normal position of FIG. 4. It is significant to note here that the nails pass from the magazine 23 into the guideway 66 through the space between the end fitting flanges 72, 74 and then through the end fitting slot 70 whose slide walls are recessed at 236 (FIG. 14) in line with the fitting base recess 76 to clear the nail heads 230. It is also significant to note that the guideway, rearwardly of the position occupied by the head of the loading nail in driving position, is slightly greater than semi-circular in cross-section. As shown best in FIG. 10, the nail driver 82 has a generally semi-cylindrical cross-section matching that of the rear guideway portion. The forward portion of the guideway is circular in cross-section with a diameter closely approximating that of the nail heads 230. A spring 238 fixed to the tool body extension presses downwardly on the heads of the underlying nails to yieldably retain the nail strip 228 properly seated in the magazine.

Integrally formed on the inner sides of the end fitting flanges 72, 74 and on the side walls of the fitting slot 70 are shoulders or anvils 240. These anvils extend some distance out from the guideway 66 to support the heads 230 of the two or three nails 226 immediately adjacent or following the leading nail currently located in driving position in the guideway.

The operation of the nail driving tool will now be explained. Assuming the tool is initially in its normal inoperative condition, the front or leading end of the end fitting extension 64 is placed against a workpiece, thereby retracting the touch probe 162 to its rear retracted position of FIG. 9. The trigger 152 is then depressed and released to effect driving of the power piston 80 and nail driver 82 through a forward driving stroke and a rearward return stroke as explained earlier. During its forward driving stroke, the driver strikes the head 230 of the leading nail 226 in driving position in the guideway 66 and drives the nail forwardly into the workpiece, shearing or breaking off the leading ends of the plastic nail strip hands 232 in the process to release the leading nail. The adjacent or immediately following nails in the magazine are supported by the anvils 240 in a way which assures proper breaking off of the plastic hands. It is also significant to note here that the tool body end fitting 20 is fabricated from a straight durable metal such as steel and may be heat treated, if necessary, to make the fitting extremely rugged. This rugged construction of the fitting coupled with the fact that anvils 240 support the nails adjacent the nail being driven and with the fact that the nail magazine 23 is firmly attached to the integral fitting flanges 70, 72 are effective to isolate the repeated impacts which are produced in operation of the tool from the nail magazine and thereby prevent bending, breaking and other damage to the magazine.

When the trigger 152 is released following driving of the loading nail, the nail driver 82 retracts with the power piston 80 to their normal position of FIG. 4. The pressure exerted on the nail strip 228 by the negator spring 204 urges the next, now leading nail in the nail strip into the guideway 66 immediately upon retraction of the nail driver sufficiently to clear the leading nail head. The leading nail then assumes a driving position in the guideway in readiness for the next operating or driving cycle of the tool.

As noted earlier and illustrated in FIG. 4, the leading end of the nail driver 82 retracts to a position some distance rearwardly of the leading nail head. This provides the power piston 80 and driver 82 with a substantial travel distance and enables the driver to acquire substantial kinetic energy before striking the nail, thus to assure proper driving of the nail into the workpiece.

Reference is now made to FIG. 16 illustrating a modified pilot valve 104*a* for the tool. This modified pilot valve is similar to the valve 104 except that the pilot valve member 106*a* of the modified valve has a rear pressure surface 242*a* on which the reservoir chamber pressure acts to bias the valve member to closed position. A net fluid pressure closing force is obtained in the valve 104*a* by providing the valve member 106*a* with a rear guide stem 244*a* which is sealed to the pilot valve body 110*a* by an O-ring 114*a* and has a diameter A less than that (B) of the trigger rod 174*a* which is threaded to the valve member.

The inventor claims:

1. A nail driving tool comprising:

a tool body having a cylinder and piston movable in the cylinder through a working stroke and a return stroke;

a plunger-like hammer extending from the cylinder to the exterior of the body for driving a nail during the work stroke;

mean for selectively pressurizing the cylinder and piston to drive the piston through a working stroke;

a removeable nail magazine containing a strip of nails being joined to each other at a central location;

said magazine having a longitudinally extending slot in the lower side thereof through which project pointed ends of the nails;

a follower mounted in said magazine for sliding movement and having a leading edge;

spaced nail engaging portions on said leading edge of said follower for engaging the rear nail of said strip of nails at opposite sides of said centrally joined portions of the rear nail;

a spring means connected to said follower and biasing said follower to slide forwardly to push said nails into position for being hit by said plunger;

means on said magazine for interfitting with portions of said tool body to removably mount the magazine thereon;

a finger piece connected to said follower and located beneath and projecting downwardly below and covered by said magazine for travel beneath said slot in the lower side of said magazine to allow the follower to be pulled rearwardly to extend said spring means;

and means projecting through said slot to join said finger piece and said follower, said tool body having a front end fitting containing a longitudinally extending slot defined by a pair of laterally projecting tongue-like flanges;

shoulder-like anvils on the inner confronting sides of said flanges adjacent said slot for supporting the heads of a plurality of nails immediately adjacent and following the leading nail in driving position, an upper and lower pin on said follower for projecting laterally for sliding engagement with said magazine, and stop means mounted on said follower for abutting said tool body to limit travel of said follower.

* * * * *